United States Patent [19]

Raasch et al.

[11] Patent Number: 4,663,929

[45] Date of Patent: May 12, 1987

[54] SPINNING ROTOR FOR AN OE-SPINNING MACHINE AND METHOD FOR PRODUCING THE SPINNING ROTOR

[75] Inventors: Hans Raasch; Heinz-Georg Wassenhoven, both of Mönchengladbach, Fed. Rep. of Germany

[73] Assignee: W. Schlafhorst & Co., Moenchengladbach, Fed. Rep. of Germany

[21] Appl. No.: 765,010

[22] Filed: Aug. 12, 1985

[30] Foreign Application Priority Data

Aug. 10, 1984 [DE] Fed. Rep. of Germany ..... 3429511

[51] Int. Cl.[4] ..... D01H 1/12

[52] U.S. Cl. ..... 57/416

[58] Field of Search ..... 57/400, 414, 416

[56] References Cited

U.S. PATENT DOCUMENTS

| | | | |
|---|---|---|---|
| 4,193,253 | 3/1980 | Herbert | 57/414 |
| 4,358,922 | 11/1982 | Feldstein | 57/401 |
| 4,385,488 | 5/1983 | Raasch et al. | 57/416 X |
| 4,397,144 | 8/1983 | Raasch et al. | 57/416 X |
| 4,492,077 | 1/1985 | Raasch et al. | 57/414 |
| 4,502,273 | 3/1985 | Miyamoto et al. | 57/414 |

*Primary Examiner*—Donald Watkins

*Attorney, Agent, or Firm*—Herbert L. Lerner; Laurence A. Greenberg

[57] ABSTRACT

A spinning rotor for an OE spinning machine includes a rotor body having a fiber sliding surface formed thereon and having a fiber collection groove formed therein defining another surface, at least one of the surfaces having a multiplicity of erosion craters formed therein, and a method for producing the spinning rotor.

7 Claims, 5 Drawing Figures

FIG. 4
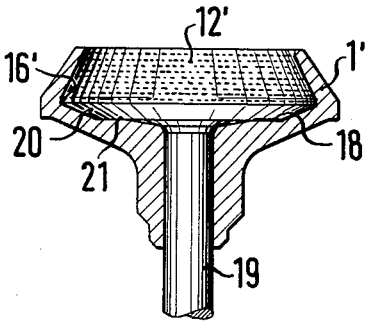
FIG. 3
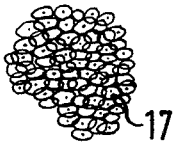
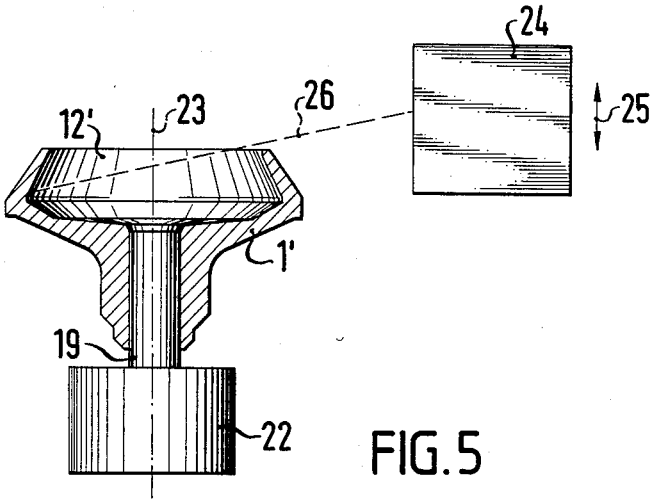
FIG. 5

SPINNING ROTOR FOR AN OE-SPINNING MACHINE AND METHOD FOR PRODUCING THE SPINNING ROTOR

The invention relates to a spinning rotor with a fiber collection groove and a fiber sliding surface for an OE (Open-End) spinning machine and a method for producing the rotor.

In conventional OE spinning machines, it has not been possible to spin yarn with good quality for a long period of time.

It is accordingly an object of the invention to provide a spinning rotor for an OE spinning machine and method for producing the spinning rotor, which overcomes the hereinafore-mentioned disadvantages of the heretofore-known methods and devices of this general type, while spinning a qualitatively good rotor yarn over a long operating time.

With the foregoing and other objects in view there is provided, in accordance with the invention, a spinning rotor for an OE spinning machine, comprising a rotor body having a fiber sliding surface formed thereon and having a fiber collection groove formed therein defining another surface, at least one of the surfaces having a multiplicity of erosion craters formed therein.

Erosion craters have a specific, irregular crater form of their own. They can be produced without great difficulty on the different material surfaces which are suited for spinning rotors. There is no material suitable for making spinning rotors, with a surface that could not be eroded. If the fiber sliding surface is provided with erosion craters, the spinning fibers orient themselves nicely during the spinning operation and a correspondingly good transition of the stretched or elongated fibers into the fiber collection groove takes place. If the fiber collection groove is also eroded, it becomes especially suitable for processing contaminated fiber material which contains dust, some foreign matter, or particles. The explanation for this is that the fiber collection groove acts like an irregular, slightly contaminated fiber collection groove from the start, so that during the continued spinning operation actual contaminations do not change the structure of the spun thread.

If the fiber collection groove is provided with erosion craters, the dirt which is eventually collected is prevented from being deposited thereon at irregular preferred locations. All of these features together lead to a very good spinning result.

With the objects of the invention in view, there is also provided a spinning rotor for an OE spinning machine, comprising a rotor body having a fiber sliding surface formed thereon and having a fiber collection groove formed therein defining another surface, at least one of the surfaces having a multiplicity of irregularly shaped and mutually irregularly overlapping erosion craters formed therein. This is achieved by intensive eroding operations, whereby new erosion craters are formed at locations where erosion craters have already been formed. Such a fiber sliding surface or fiber collection groove which is densely populated by erosion craters leads to especially good spinning results, independently of other spinning conditions and fiber materials.

In accordance with another feature of the invention, the erosion craters are spark or electric arc erosion craters. However, this should not be interpreted as a limitation with respect to the physical principles or methods by which the erosion craters are produced.

In accordance with a further feature of the invention, there is provided a surface coating or layer formed of wear or corrosion resistant material covering the erosion craters. For example, a surface layer can be applied to the fiber sliding surface or to the fiber collection groove before the eroding process. The surface coating is carried out after the eroding.

It is advantageous if the surface coating or the surface layer is interlinked or meshed with the base material of the erosion craters, but it also can be diffused into the base material.

In accordance with an added feature of the invention, the rotor body is formed of steel and the erosion craters have a surface layer formed of at least one chemical combination of a non-metal and a metal. For example, borides, carbides, silicides and nitrides of iron, chromium, nickel, titanium, molybdenum or tungsten should be considered for such chemical combinations or compounds.

In accordance with an additional feature of the invention, the surface layer is formed of at least one boride. Boride is preferred if the spinning rotor is made of steel.

In accordance with again another feature of the invention, the rotor body is formed of hardened or hardenable, tempered steel.

In accordance with again a further feature of the invention, the erosion craters have a protective surface layer containing a foreign metal. For instance, the protective surface layer could be a zinc layer. A protective surface layer of this type serves mainly as a corrosion protection. The outer skin of the protective surface layer can advantageously be formed of a chemical compound of a metal with an inorganic substance, such as oxide, phosphate or chromate.

There is also provided a method of producing a spinning rotor for an OE spinning machine, which comprises prefabricating the outside or raw form of a rotor body at least partly of an electrically conducting material, forming a fiber sliding surface on the rotor body, forming a fiber collection groove in the rotor body defining another surface, forming at least one of the surfaces in the electrically conductive material, and eroding at least one of the surfaces to form lumps and a multiplicity of craters therein.

The point or crater-shaped eroding does not imply that only one erosion crater is created after the other, on the contrary the procedure is carried out in such a way that erosion craters are generated at different places at the same time.

In accordance with another mode of the invention, there is provided a method which comprises placing a tooling electrode in the rotor body, placing a dielectric between the tooling electrode and at least one of the surfaces, and forming the erosion craters by removing material with moving or non-stationary, temporally or time-wise separated electrical discharges passing from the tooling electrode through the dielectric to at least one of the surfaces. For example, the electrical discharges may be generated in a spark generator.

In accordance with a further mode of the invention, there is provided a method which comprises providing the electrical discharges in the form of at least one periodically interrupted and repeatedly ionized or ignited electric arc. The interruption of the electric arc can be effected by increasing the gap between the tooling electrode and the spinning rotor, and the re-ignition or ionization of the electric arc is achieved by causing the tooling electrode to approach the spinning rotor.

In accordance with an added mode of the invention, there is provided a method which comprises placing a tooling electrode in the rotor body, placing a dielectric between the tooling electrode and at least one of the surfaces, and forming the erosion craters by removing material with at least one periodically interrupted, energy-rich particle beam or wave action or radiation beam passing from the tooling electrode through the dielectric to at least one of the surfaces. The energy-rich interrupted particle beam may come from a particle accelerator. The interrupted particle beam is directed in such a way that it always impinges at different locations on the inner surface of the rotor.

In accordance with again an additional mode of the invention, there is provided a method which comprises placing a tooling electrode in the rotor body, placing a dielectric between the tooling electrode and at least one of the surfaces, and forming the erosion craters by removing material with at least one periodocally interrupted maser or laser beam passing from the tooling electrode through the dielectric to at least one of the surfaces.

In accordance with still another mode of the invention, there is provided a method which comprises moving the rotor body relative to the tooling electrode or erosion tool during the formation of the erosion craters. Erosion tools.have been mentioned above. A particle accelerator or the like should also be considered as an erosion tool.

It is advantageous if at least the interior part of the rotor which comes in contact with the fibers, is provided with a surface layer which may contain one or more chemical compounds of a non-metal with a metal, either before or after the erosion of the fiber sliding and/or fiber collection groove. In this case, the entire inner surface of the spinning rotor comes in contact with the fiber and is provided with the above-mentioned surface layer.

As an alternative, the same part of the spinning rotor can be provided with a surface coating or a surface layer, which is formed of a wear resistant and/or corrosion resistant material The surface coating or surface layer is advantageously formed individually or in combination of borides, carbides, silicides, or nitrides of iron, chromium, nickel, titanium, molybdenum or tungsten.

It is advantageous if the spinning rotor is made of hardenable steel and is heat treated before or after the eroding process of the fiber sliding surface and/or fiber collection groove, so that the toughness of the material is greatly improved For this purpose, after the surface layer has been applied, the spinning rotor is heated to a temperature of 820 to 840 degrees Celsius, then quenched, and thereafter tempered to 380 to 420 degrees Celsius.

In accordance with a concomitant mode of the invention,there is provided a method wherein the rotor body has a lower surface, which comprises subjecting at least one of the other and lower surfaces to a final surface treatment by polishing.

The good spinning results made possible by practicing the invention can be further improved in this way. The bottom of the rotor, i.e. the part of the interior of the rotor which leads from the fiber collection groove to the rotor axis, should be polished in any case for better spinning results. The fiber collection groove need only be polished if it does not contain any erosion craters. The polished surfaces are advantageously produced by burnishing.

Other features which are considered as characteristic for the invention are set forth in the appended claims.

Although the invention is illustrated and described herein as embodied in a spinning rotor for an OE spinning machine and method for producing the spinning rotor, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 3 is an enlarged view of an eroded fiber sliding surface;

FIG. 4 is a fragmentary, cross-sectional view of a spinning rotor, which was eroded and provided with a surface coating; and FIG. 5 is a view of a spinning rotor similar to FIG. 4 during the eroding process carried out by means of a particle accelerator.

Figure 1:
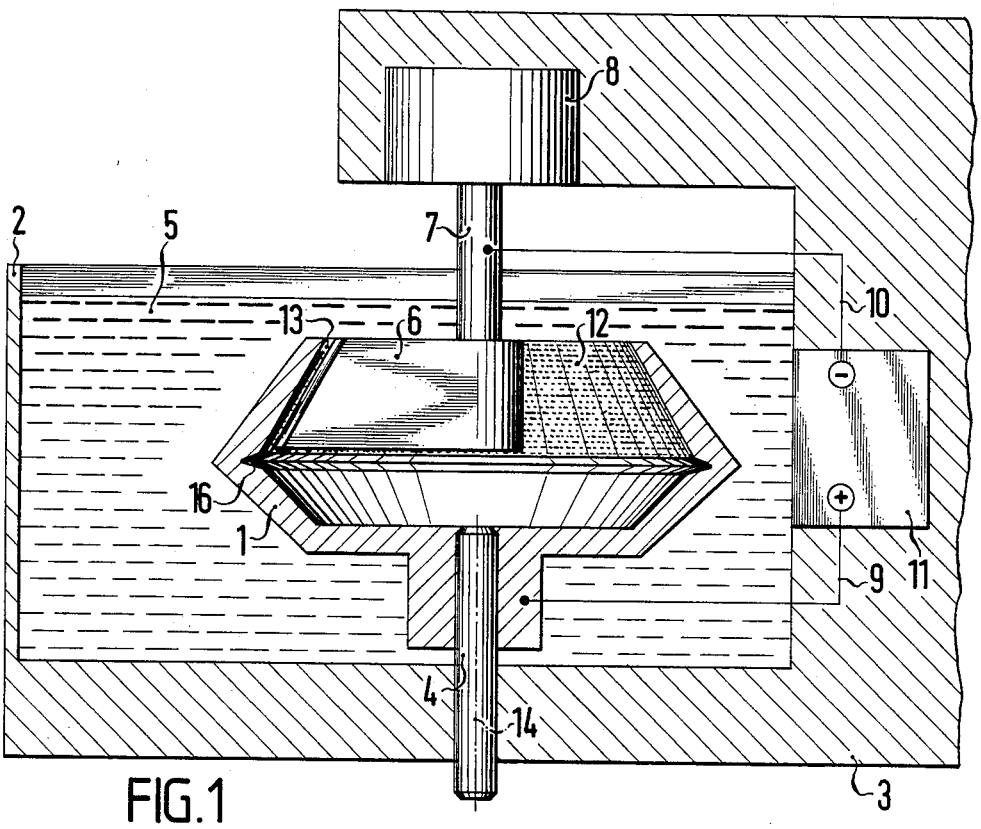
FIG. 1 is a fragmentary, diagrammatic, cross-sectional view of a spinning rotor during the spark erosion process.

Referring now to the figures of the drawing in detail and first, particularly to FIG. 1 thereof, it is seen that a spinning rotor 1 is positioned in the tank or vat 2 of a spark erosion machine 3. The rotor 1 is positioned in the tank on a holder 4 with its opening facing upward. The tank 2 is filled with petroleum which serves as a dielectric 5. A tooling electrode 6 is connected with a feeding and electrode rotating device 8 by a holder 7. The spinning rotor 1 is connected by an electric line 9 to the positive pole of a spark generator 11 and the holder 7 is connected to the negative pole of the spark generator 11. The tooling electrode 6 matches the conical contour of a fiber sliding surface 12 of the spinning rotor 1. The electrode 6 is spaced a given distance 13 from this surface 12 definin a gap which is filled by the dielectric 5. The electrode feeding and rotating device 8 rotates the tooling electrode 6 about the longitudinal axis 14 of the spinning rotor 1, so that sparks bridge the distance between the tooling electrode 6 and the fiber sliding surface 12. Each spark causes an erosive material removal to take place on the rotor body forming an erosion crater or pit. This also causes a certain material loss to occur at the electrode, which is compensated by feeding the electrode 6 by means of the feeding and rotating device 8, so that a constant gap 13 of about 0.05 mm is maintained. The alternating effect of the sparks cause the electrode wear and the erosion caused by the jumping sparks to be distributed over the surface of the tooling electrode 6, which is turned toward the fiber sliding surface 12.

In the illustrated embodiment, the pulse frequency is several kiloHerz, the operating voltage is maximally 50 Volts and the operating current is maximally 20 amperes. However, these data are only given as examples and should not be interpreted as limiting values.

Figure 2:
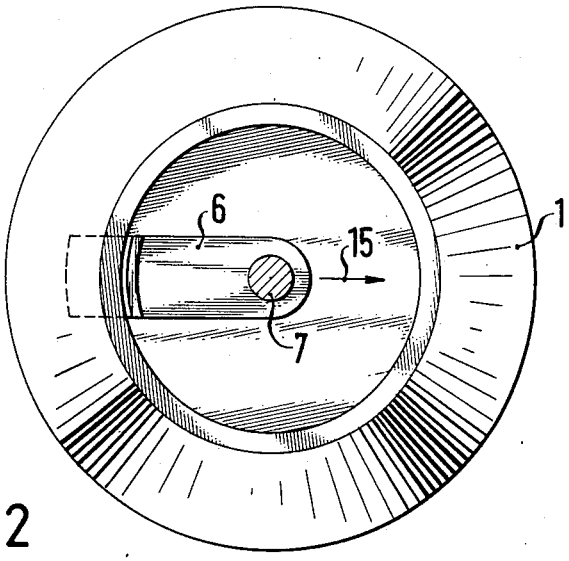
FIG. 2 is a top-plan view of the spinning rotor and the eroding tool of FIG. 1.

FIG. 2 is a top view showing the position of the tooling electrode 6 inside the spinning rotor 1. For insertion and removal of the tooling electrode 6, the holder 7 can be moved in the direction of an arrow 15 and subsequently lifted out by the feeding and rotating device 8.

With this particular construction and disposition of the tooling electrode 6, the fiber collection groove 16 of the spinning rotor 1 does not have any erosion craters.

After the erosion process, the fiber sliding surface 12 has the appearance as shown on an enlarged scale in FIG. 3. Larger and smaller erosion craters 17 lie closely adjacent each other and overlap each other partially. The erosion craters have irregular shapes. Each crater forms a depression with a depth that varies from crater to crater. The erosion craters are visible to the naked eye and their size can be varied within quite a wide range by adjusting the pulse frequency, the operating voltage, and the operating current.

While the spinning rotor 1 according to FIG. 1 has a fiber collection groove 16 which is clearly defined and limited from the fiber sliding surface 12, this is not the case with the spinning rotor 1' shown in FIG. 4. In FIG. 4, the fiber sliding surface 12' blends almost in a straight line into the fiber collection groove 16' and the erosion craters reach into the fiber collection groove 16'. The right half of FIG. 4 indicates that the entire interior of the spinning rotor 1' is provided with a surface coating 18. After the surface coating 18 is applied to the bottom of the rotor, formed of a conical part 20 and a flat part 21, it is polished in a final surface treatment. The polishing operation is facilitated by the fact that the spinning rotor 1' has already been provided with a shaft 19.

FIG. 5 indicates the method of providing the spinning rotor 1' shown in FIG. 4 with the erosion craters.

The shaft 19 of the spinning rotor 1' is rotated about a longitudinal axis 23 by a rotating device 22. A particle accelerator 24, which performs a controlled up and down motion in the direction of the double arrow 25, emits a pulsed beam 26 of atomic particles, which impact onto the fiber sliding surface 12' of the rotating spinning rotor 1' and generate the erosion craters there.

Instead of using the particle accelerator 24, as an alternative it is also possible to use a laser or maser device.

Instead of a spark erosion machine 3 as used in the embodiment of FIG. 1, it is also possible to use a similarly constructed electric arc erosion machine, in which case the tooling electrode 6 continuously approaches and moves away from the fiber sliding surface in a steady back and forth motion. Instead of the spark generator 1, in this case a voltage generator is used.

The invention is not limited to the illustrated and described embodiments, which were used as an example.

The spinning rotor 1 according to FIG. 1, is especially suited for the spinning of fine yarns, while the spinning rotor 1' according to FIG. 4, is especially suited for spinning coarse yarns.

We claim:

1. Spinning rotor for an OE spinning machine, comprising a rotor body having a fiber sliding surface formed thereon and having a fiber collection groove formed therein defining another surface, at least one of said surfaces having a multiplicity of irregularly shaped and mutually irregularly overlapping erosion craters formed therein.

2. Spinning rotor according to claim 1, including a surface coating formed of wear resistant material covering said erosion craters.

3. Spinning rotor according to claim 1, including a surface coating formed of corrosion resistant material covering said erosion craters.

4. Spinning rotor according to claim 1, wherein said rotor body is formed of steel and said erosion craters have a surface layer formed of at least one chemical combination of a non-metal and a metal.

5. Spinning rotor according to claim 4, wherein said surface layer is formed of at least one boride.

6. Spinning rotor according to claim 1, wherein said rotor body is formed of hardened steel.

7. Spinning rotor according to claim 1, wherein said erosion craters have a protective surface layer containing a foreign metal.

* * * * *